US005729952A

United States Patent [19]

Dahl

[11] Patent Number: 5,729,952

[45] Date of Patent: Mar. 24, 1998

[54] MECHANICAL REBAR COUPLERS

[76] Inventor: Kjell L. Dahl, 919 Bayside Dr., Newport Beach, Calif. 92660

[21] Appl. No.: 570,099

[22] Filed: Dec. 11, 1995

[51] Int. Cl.[6] ..... E04C 5/16; E04C 5/00

[52] U.S. Cl. ..... 52/740.7; 29/437; 29/443; 29/444; 29/445; 52/740.1; 52/742.13; 403/269; 403/300; 403/305

[58] Field of Search ..... 52/295, 726.1, 52/740.1, 740.6, 740.7, 742.13, 742.16; 403/269, 300, 305; 29/434, 437, 443, 444, 445

[56] References Cited

U.S. PATENT DOCUMENTS

| | | | |
|---|---|---|---|
| 1,733,392 | 10/1929 | Barra | 403/305 |
| 3,406,443 | 10/1968 | DeRidder | 403/300 X |
| 3,638,978 | 2/1972 | Guntermann | 403/269 X |
| 4,095,389 | 6/1978 | Outram et al. | 52/726.1 X |
| 4,152,817 | 5/1979 | Cotten | 29/437 X |
| 4,619,096 | 10/1986 | Lancelot, III | 52/726.1 |
| 5,152,118 | 10/1992 | Lancelot | 52/726.1 |
| 5,305,573 | 4/1994 | Baumann | 52/726.1 |
| 5,308,184 | 5/1994 | Bernard | 52/726.1 X |

FOREIGN PATENT DOCUMENTS

| | | | |
|---|---|---|---|
| 98099 | 1/1984 | European Pat. Off. | 52/726.1 |
| 547319 | 6/1993 | European Pat. Off. | 52/740.1 |
| 266612 | 4/1989 | Germany | 52/740.1 |
| 4-330144 | 11/1992 | Japan | 52/740.1 |
| 844726 | 7/1981 | U.S.S.R. | 52/740.1 |
| WO92/04514 | 3/1992 | WIPO | 52/740.1 |

*Primary Examiner*—Carl D. Friedman
*Assistant Examiner*—Kevin D. Wilkens
*Attorney, Agent, or Firm*—Morland C. Fischer

[57] ABSTRACT

Methods and apparatus for making and assembling reliable mechanical rebar couplers so that a short upstand of rebar that protrudes from an existing concrete structure can be connected to a new rebar at a retrofit work site out in the field so as to provide a connection between a new and the existing structure. According to a first embodiment, one end of the protruding upstand is upset, and a threaded male coupling member surrounds the protruding upstand behind the upset end thereof. The threaded male coupling member is mated to a threaded female coupling member that is affixed to the new rebar such that the upset end of the upstand is retained between the male and female coupling members. According to a second embodiment, one end of each of the protruding upstand and the new rebar is upset, and a threaded male coupling member surrounds the protruding upstand and the new rebar behind the respective upset ends thereof. The threaded male coupling members are then mated to opposite threaded ends of a hollow cylindrical female coupling member so that the upset ends of the protruding upstand and the new rebar are retained at the interior of the female coupling member.

19 Claims, 4 Drawing Sheets

18
10
23
24
28
26
14
16
22
6
4
1
2
20

MECHANICAL REBAR COUPLERS

BACKGROUND OF THE INVENTION

1. Field of the Invention

This invention relates to simple and inexpensive methods and apparatus for making and assembling reliable mechanical rebar couplers by which to permit a short upstand of rebar that protrudes from an existing concrete structure to be extended at a retrofit work site out in the field so as to provide a connection between a new structure and the existing structure.

2. Background Art

It is not uncommon in the construction industry for there to exist a need to add a new concrete structure to an existing concrete structure. For example, at retrofit work sites involving expanding airports, reinforcing bridges, rebuilding elevated roadways, and upgrading naval docking facilities, to name a few, a new structure is fixedly connected to an existing structure in a manner that will prevent the new structure from shifting relative to the existing structure.

The foregoing has typically been accomplished by means of extending the length of rebars that are embedded in the existing structure so as to provide continuous reinforcement between the existing and new structures. However, certain problems have been encountered when attempting to extend the length of the original rebar to form a reliable connection between the existing and new structures that is capable of withstanding high mechanical shear force and tensile and compressive loads.

More particularly, it is not always an easy task to modify the rebar of an existing concrete structure at a retrofit work site. In some cases, a relatively lengthy upstand of original rebar is required before the original rebar can be spliced to a new section of rebar to thereby extend the overall length thereof. In other cases, it becomes necessary to rotate the original rebar in order that such rebar can be coupled to a section of new rebar. However, attempting to rotate original rebar that is embedded in concrete is impractical. In still other cases, couplings that have been used in the past to splice original and new sections of rebar have proven to be weaker than the rebar itself. Consequently, such couplings have failed before the rebar which adversely effects the reliability of the coupler and the integrity of the concrete structure.

Examples of conventional mechanical splicing and coupling techniques for connecting sections of rebar are available by referring to the following United States patents:

| | | |
|---|---|---|
| 4,619,096 | H. B. Lancelot | October 28, 1986 |
| 4,666,326 | P. F. Hope | May 19, 1987 |
| 5,046,878 | B. W. Young | September, 10, 1991 |
| 5,152,118 | H. B. Lancelot | October 6, 1992 |
| 5,261,198 | L. S. McMillan | November 16, 1993 |
| 5,366,672 | J. Albrigo et al | November 22, 1994 |

SUMMARY OF THE INVENTION

In general terms, disclosed herein are simple and inexpensive methods and apparatus for making and using a reliable mechanical rebar coupler by which to permit a short upstand of original rebar that protrudes from an existing concrete structure to be extended in the field so as to provide the connection between a new structure and an existing structure. Pursuant to a first embodiment of this invention, the rebar coupler is formed by heating and deforming the protruding end of the original rebar embedded in the existing structure so as to form an upset head. More particularly, an externally threaded male coupling nut is located around the protruding end of the original rebar. A split forming die is clamped to the upstand, and the protruding end is upset by first melting the protruding end with a heating torch and then deforming the end with either an electric hammer or a hydraulic jack. The heating and deforming steps may be repeated any number of times until the protruding end of the original embedded rebar is upset to form a relatively wide head. Next, an internally threaded female coupling member that is welded to a new section of rebar is mated to the threaded male coupling nut with the upset head of the protruding end captured between the male and female coupling members. Accordingly, the original and new sections of rebar are coupled together to form a continuous reinforcement for connecting the new structure to the existing structure. A channel is formed within the female coupling member and grout is injected therewithin to enable the rebar coupler to better withstand compressive loads that may be applied thereto.

Pursuant to a second embodiment of this invention, an externally threaded male coupling nut is located around each of the protruding end of the original rebar and a first end of the new rebar to be spliced to the original rebar. A relatively wide head is then formed by heating and upsetting the protruding and first ends of the original and new rebars by means of a heating torch and an electric hammer or hydraulic jack. The rebar coupler is assembled when the external threads of the coupling nuts are mated to internal threads at opposite ends of a hollow, cylindrical coupling sleeve so that the respective upset heads of the original and new rebars are held in facing alignment with one another against an annular wall that extends around the inside perimeter of the coupling sleeve. The annular wall functions as a stop against which the upset heads of the original and new rebars are seated to establish a central chamber therebetween. A channel is formed through the coupling sleeve to communicate with the central channel, and grout is injected therewithin to enable the rebar coupler to better withstand compressive loads that may be applied thereto.

DETAILED DESCRIPTION

Figure 1:
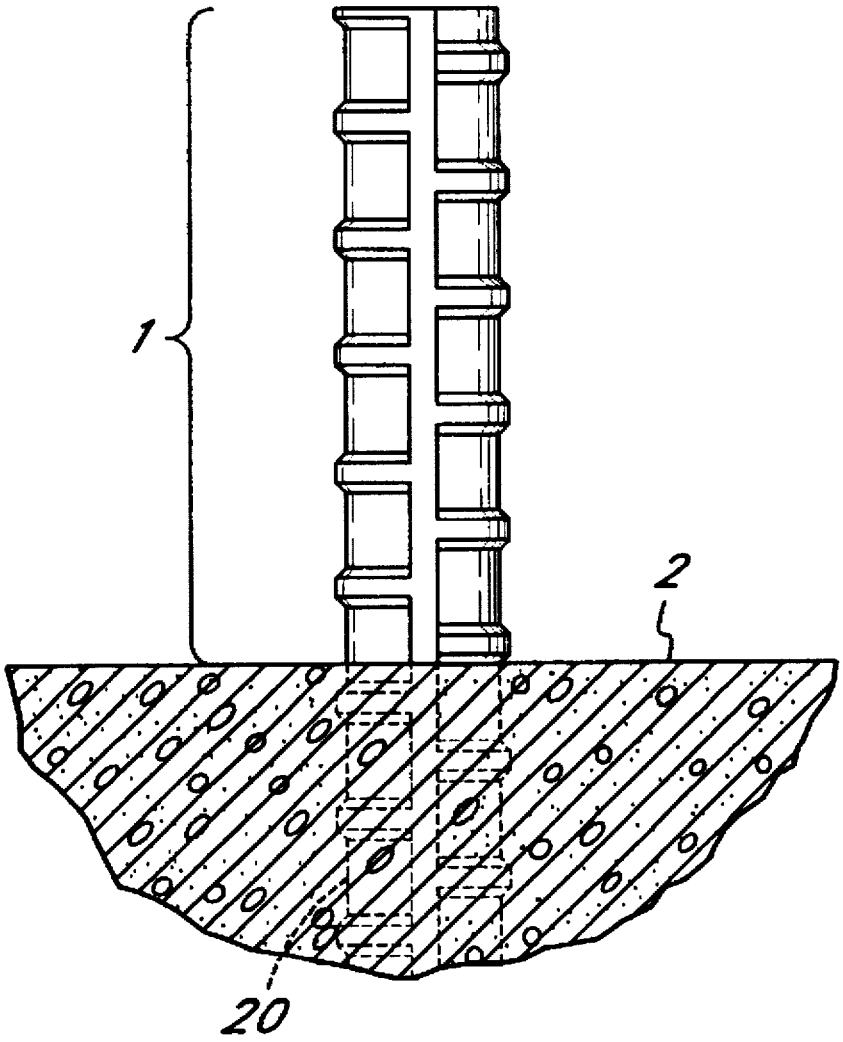
Fig. 1 (PRIOR ART)
FIG. 1 shows an upstand of original rebar protruding from an existing concrete structure in which the rebar has been embedded.

The method and apparatus for making and using a reliable mechanical rebar coupler which form the present invention are now described while referring to the drawings, where FIGS. 1–4 show a rebar coupler 10 according to a first embodiment. FIG. 1 shows the protruding end 1 of a (e.g. 25 mm diameter) steel rebar 20 that is embedded in an existing structure 2, such as that formed from concrete, or the like. Although only a single rebar 20 is illustrated, it is to be understood that the existing structure 2 would typically have a plurality of rebars, the lengths of which are to be extended at a retrofit work site out in the field to provide continuous support for a new structure (not shown) that is to be constructed over or adjacent to the existing structure 2.

Figure 2:
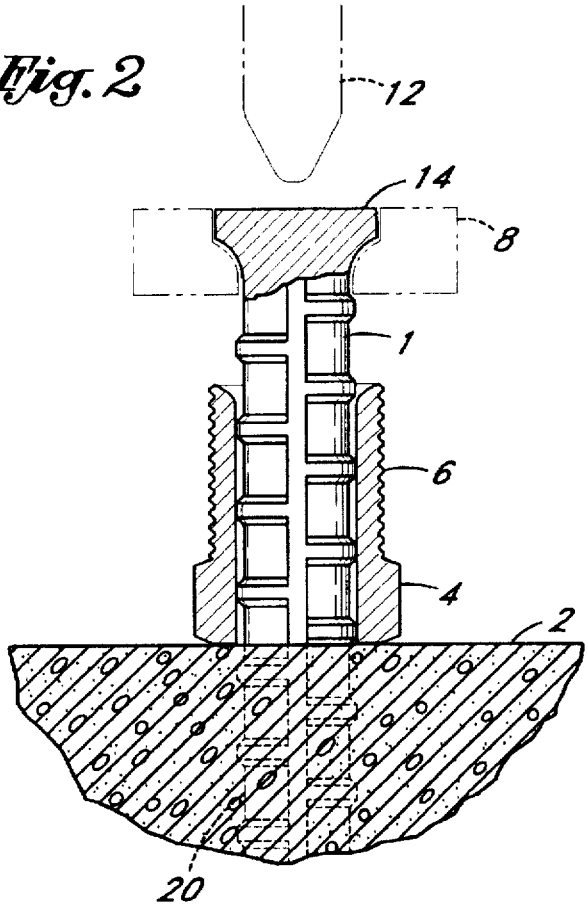
FIGS. 2 and 3 illustrate the steps of heating and then deforming the protruding upstand of the original rebar so as to form an upset head.
Figure 3:
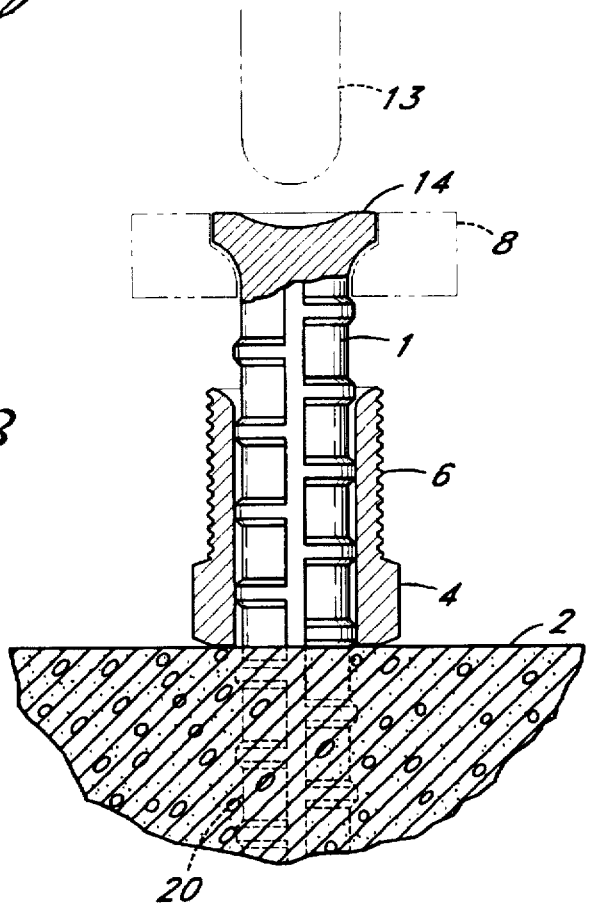

FIGS. 2 and 3 illustrate the steps for forming the rebar coupler (designated 10 in FIG. 4) according to a method of heating and upsetting the protruding end 1 of the original rebar 20. By virtue of the foregoing, only a short upstand (e.g. approximately four inches) of rebar 20 need be exposed on which to assemble the coupler 10 according to the method of this embodiment. More particularly, a cylindrical male coupling member 4 (e.g. a swivel nut) having a series of external screw threads 6 extending around the outside perimeter thereof is initially positioned over the protruding end 1 of the original rebar 20 to be extended in length. A conventional split forming die (shown in phantom lines and designated by the reference numeral 8) is clamped to the protruding end 1 of the rebar 20. As will be understood by those skilled in the art, the split forming die 8 includes a pair of die sections that form a cylindrical collar in surrounding engagement with the protruding end 1 of the rebar 20 to define and control the upset profile and diameter after the protruding end is heated and deformed.

In this regard, and as illustrated in FIG. 2, the protruding end 1 of the original embedded rebar 20 is heated for approximately one minute to a temperature of about 1000 degrees C. by means of a conventional oxy-acetylene heating torch (represented in phantom lines and designated by the reference numeral 12). The heating is then suspended and, as is illustrated in FIG. 3, the protruding end 1 of rebar 20 is deformed by either an electric impact hammer (e.g. a 1400 watt hammer producing 1600 impacts per minute available from Milwaukee Corporation) or a hydraulic jack (e.g. a 30 ton heavy duty hydraulic jack manufactured by Enerpac) in order to upset the protruding end 1. The electric hammer or hydraulic jack is represented in phantom lines by reference numeral 13. The aforementioned steps of heating the protruding end with a heating torch and striking the heated end with an impact hammer or hydraulic jack may be repeated one or more times until the protruding end 1 of rebar 20 has been sufficiently upset to establish a relatively wide head 14 having a diameter that is about 0.5 inches larger than the diameter of the original rebar 20. At this point, the upset head 14 is permitted to cool.

As indicated above, the precise size and shape of the upset head 14 is determined by the split forming die 8 that is clamped in surrounding engagement with the protruding end 1 of rebar 20. However, the diameter of the upset head 14 should be slightly greater than the inside diameter of the male coupling nut 4 and slightly less than the inside diameter of the female coupling member 16 for a reason that will soon be apparent.

Figure 4:
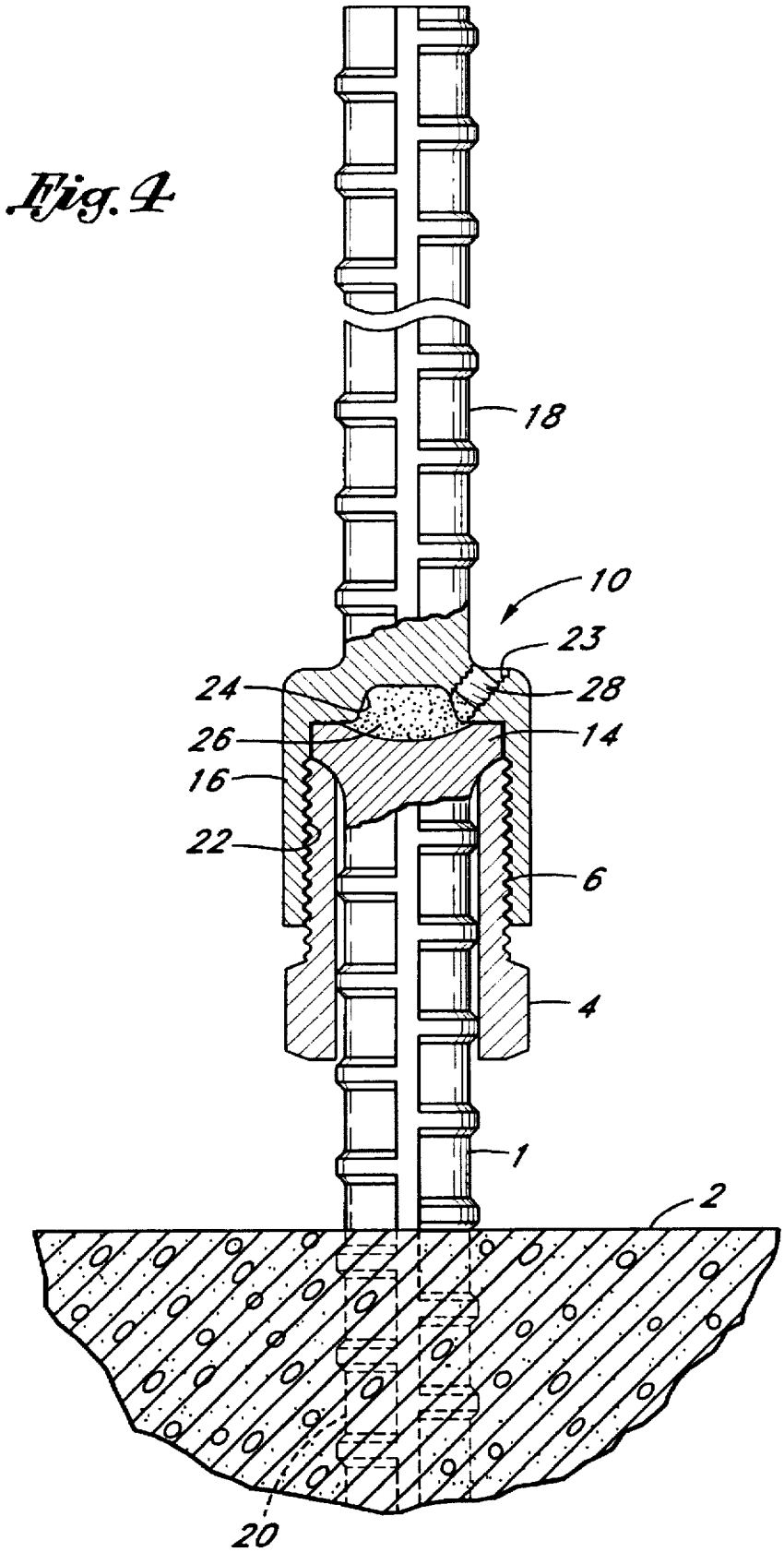
FIG. 4 shows a mechanical rebar coupler according to a first embodiment of this invention in the assembled configuration to splice a new section of rebar to the protruding upstand of the original rebar on which the upset head has been formed.

Referring specifically now to FIG. 4, the coupler 10 is assembled when a cylindrical female coupling member 16 is mated to the male coupling nut 4 that surrounds the protruding end 1 of rebar 20. The female coupling member 16 is coextensively connected (e.g. forge welded) to the section of new rebar 18 that is to be coupled to the original rebar 20. The welding of female coupling member 16 to new rebar 18 may take place at any convenient off-site location (e.g. in the shop). The female coupling member 16 has a series of internal screw threads that extend around the inside perimeter thereof and an outside diameter that is larger than the outside diameter of the male coupling nut 4.

The rebar coupler 10 is assembled when the external threads 6 of the male coupling nut 4 are mated to the internal threads 22 of the female coupling member 16 with the upset head 14 being captured between couplings 4 and 16. Therefore, and by virtue of the upset head 14 that has been formed on the protruding end 1 of original rebar 20, the coupler 10 formed by the connection of the male and female coupling members 4 and 16 cannot be separated from the original rebar 20, whereby the new rebar 18 is reliably joined to the original rebar 20 in order to extend the length of rebar 20 so as to continuously reinforce a new structure that will be constructed over or adjacent to the existing structure 1. What is even more, the diameter of the new rebar 18 may be made the same as or different from the diameter of original rebar 20. By way of example only, an existing pile and a new footing may be mechanically connected together without any loss of strength at the interface therebetween.

Mating the male and female coupling members 4 and 16 together at the respective screw threads 6 and 22 thereof enables the rebar coupler 10 to be better able to resist shear, tensile and compressive loads. In fact, the rebar coupler 10 of this invention has been shown to be capable of developing the full tensile capacity of standard A706 reinforcement steel as if no coupler had been present (i.e. the coupler 10 is as strong as a continuous section of rebar). The rebar coupler 10 and the method for making said coupler have been found to be particularly suitable for sizes of rebar from No. 5 up to No. 18 (i.e. 15 mm to 55 mm).

While the screw threads 6 and 22 of coupling members 4 and 16 enable the rebar coupler 10 of this embodiment to resist tensile loads, the coupler 10 can also be adapted to withstand compressive forces. More particularly, and continuing to refer to FIG. 4, a channel 23 is drilled through the relatively large female coupling member 16. The channel 23 communicates with a hollow chamber 24 that is established at the interior of the female coupling member 16. After the rebar coupler 10 has been assembled in the manner described above, the chamber 24 is injected with an epoxy grout or cement 26 via the channel 22.

In the assembled coupler configuration, the chamber 24 of female coupling member 16 lies adjacent the upset head 14 of the original rebar 20. Thus, the grout 26 will fill chamber 24 up to the interface of the original rebar 20 with the female coupling member 16 to enable the coupler 10 to better withstand compressive forces that might be generated if the existing structure 20 and the new structure to be constructed thereagainst were to move towards one another. A suitable plug 28 can be located within the channel 23 through coupling member 16 to isolate the grout 26 within chamber 24 from the atmosphere.

Figure 5:
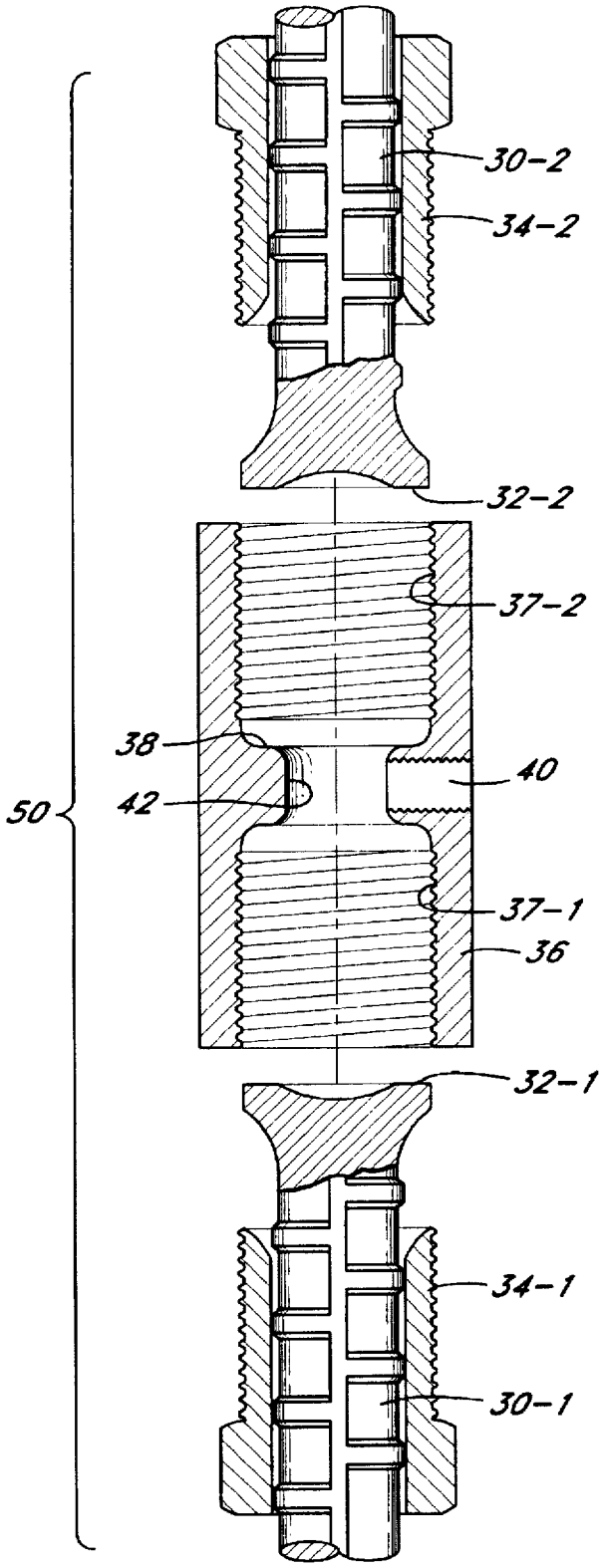
FIG. 5 shows an exploded view of a mechanical rebar coupler according to a second embodiment of this invention to splice a new section of rebar having an upset head to an upstand of original rebar protruding from a concrete structure and having an upset head.
Figure 6:
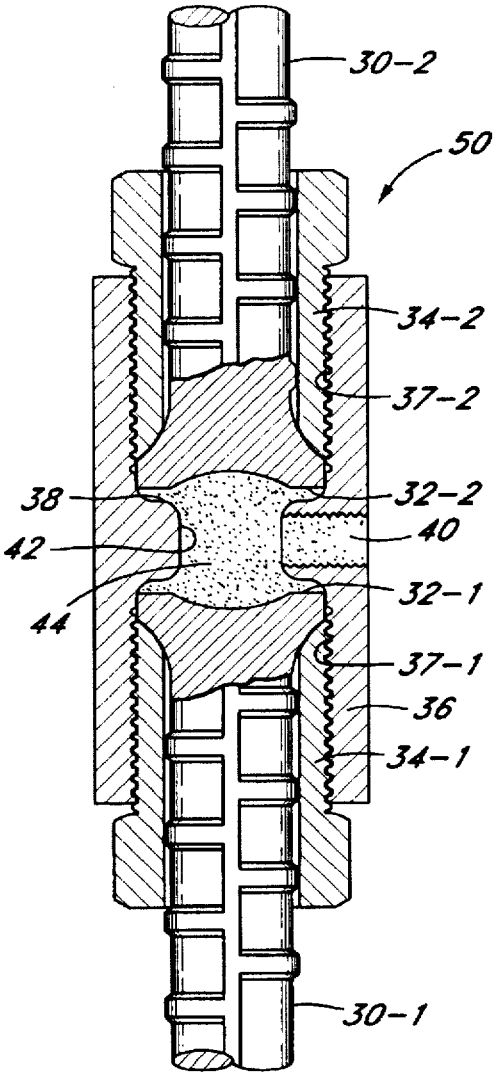
FIG. 6 shows the rebar coupler of FIG. 5 in the assembled configuration.

A relatively low cost, easy to assemble mechanical coupler 50 according to a second embodiment of this invention is now disclosed while referring to FIGS. 5 and 6 of the drawings. Like the rebar coupler 10 of FIGS. 1–3, the rebar coupler 50 is adapted to permit a short upstand of rebar 30-1 that protrudes from an existing concrete structure (not shown) to be extended at a retrofit work site so as to provide a reliable connection between a new structure and the existing structure.

In this same regard, a relatively wide upset head 32-1 is formed on the protruding end of the original rebar 30-1 by the method steps previously described when referring to FIGS. 2 and 3. That is, an externally threaded male coupling nut 34-1 is first positioned around the original rebar upstand 30-1 to be extended in length. After a split forming die (designated 8 in FIGS. 2 and 3) is clamped to the rebar 30-1, the protruding end thereof is heated by a torch (designated 12 in FIG. 2) and then upset by either an electric hammer or a hydraulic jack (designated 13 in FIG. 3). The steps of heating and deforming the protruding end may be repeated until a suitable upset head 32-1 has been formed.

However, unlike the rebar coupler 10 shown in FIG. 4, a relatively wide upset head 32-2 is also formed on the end of the new rebar 30-2 that is to be spliced to the original rebar upstand 30-1. The upset head 32-2 is formed on new rebar 30-2 by following the same method steps of heating and deforming that were just described to form the upset head 32-1 on the protruding end of rebar 30-1. Therefore, an externally threaded male coupling nut 34-2 surrounds the new rebar 30-2 behind the upset head 32-2 formed thereon.

In accordance with this second embodiment, the original and new rebars 30-1 and 30-2 are coupled together by means of a hollow, cylindrical female coupling sleeve 36. The coupling sleeve 36 is preferably manufactured from steel and includes a set of internal screw threads 37-1 and 37-2 that extend around the inside perimeter at each end thereof. An annular wall 38 extends around the interior of coupling sleeve 36 and projects radially inward thereof at approximately the mid-point of sleeve 36. A radial channel 40 is drilled through the coupling sleeve 36 and the wall 38 so as to communicate with a central chamber 42 that is established at the interior of the sleeve 36 in the area surrounded by annular wall 38.

The rebar coupler 50 of FIGS. 5 and 6 is assembled when the external threads of the male coupling nuts 34-1 and 34-2 are mated to the internal threads 37-1 and 37-2 of the female coupling sleeve 36 with the respective upset heads 32-1 and 32-2 of the original and new rebars 30-1 and 30-2 held in facing alignment with one another adjacent opposing sides of annular wall 38. Thus, the wall 38 functions as an axial stop against which the upset heads 32-1 and 32-2 are seated to create the central chamber 42 therebetween.

Accordingly, the upset heads 32-1 and 32-2 are captured within the opposite ends of coupling sleeve 36 so that the new rebar 30-2 cannot be separated from the original rebar upstand 30-1, whereby the new rebar 30-2 is reliably spliced to the original rebar 30-1 in order to extend the length of original rebar 30-1 and thereby reinforce a concrete structure that is constructed over or adjacent to an existing structure. Like the rebar coupler 10 shown in FIGS. 1–4 of the drawings, the rebar coupler 50 shown in FIGS. 5 and 6 of the drawings is able to resist shear, tensile and compressive forces and loads so as to be as strong as the rebar (e.g. A706 reinforcement steel).

After the rebar coupler 50 has been assembled, as just described, the central chamber 42 that is located between the oppositely facing upset heads 31-1 and 32-2 of rebars 30-1 and 30-2 may be filled with epoxy grout or cement 44 via the radial channel 40 extending through sleeve 36 and wall 38. In this regard, the coupler 50 will be better able to withstand the compressive forces that might be generated if the existing and new structures were to move towards one another.

It will be apparent that while the preferred embodiments of the invention has been shown and described, various modifications and changes may be made without departing from the true spirit and scope of the invention.

Having thus set forth the preferred embodiments, what is claimed is:

1. A mechanical rebar coupler for joining a first rebar to second rebar, said coupler comprising:

a cylindrical male coupling member having inside and outside diameters and a set of screw threads, said male coupling member surrounding a first end of said first rebar;

an upset head formed on said first end of said first rebar, said upset head being larger than the inside diameter of said male coupling member to prevent the removal of said male coupling member from said first end; and a cylindrical female coupling member having a set of screw threads, said female coupling member being attached to a first end of said second rebar and having an inside diameter that is larger than said upset head, the set of screw threads of said male coupling member being mated to the set of screw threads of said female coupling member to connect said male and female coupling members together with said upset head retained between said male and female coupling members.

2. The rebar coupler recited in claim 1, wherein said male coupling member is a hollow nut, the set of screw threads of said male coupling member extending around the exterior of said hollow nut.

3. The rebar coupler recited in claim 2, wherein said female coupling member is a hollow cylinder that is sized to surround said hollow nut, said set of screw threads of said female coupling member extending around the interior of said hollow cylinder to be mated to the set of screw threads extending around the exterior of said hollow nut.

4. The rebar coupler recited in claim 1, further comprising a supply of grout located between said upset head formed on said first end of said first rebar and said screw threaded female coupling member to absorb compressive loads applied to said first and second rebars.

5. The rebar coupler recited in claim 4, further comprising a channel formed through said screw threaded female coupling member to deliver said supply of grout between said upset head and said screw threaded female coupling member.

6. A method for coupling a first rebar to a second rebar, said method comprising the steps of:

locating a hollow male coupling nut having external screw threads around a first end of said first rebar;

upsetting said first end of said first rebar to form a relatively wide head and thereby block the removal of said hollow male coupling nut from said first end;

attaching a female coupling cylinder having internal screw threads to a first end of said second rebar; and connecting said female coupling cylinder around said male coupling nut at the respective internal and external screw threads thereof such that said relatively wide head formed on said first end of said first rebar is retained between said female coupling cylinder and said male coupling nut and said relatively wide head of said first rebar and said first end of said second rebar extend in opposite facing alignment with one another.

7. The method recited in claim 6, including the additional step of clamping a split forming die around said first end of said first rebar during the step of upsetting said first end to control the size and shape of said relatively wide head formed on said first end.

8. The method recited in claim 6, including the additional step of injecting grout between said relatively wide head formed on said first end of said first rebar and said female coupling cylinder attached to said second rebar in order to absorb compressive loads applied to said first and second rebars.

9. The method recited in claim 6, including the additional step of upsetting said first end of said first rebar by first heating said first end and then deforming said first end.

10. The method recited in claim 9, including the additional step of heating said first end of said first rebar by means of a torch.

11. The method recited in claim 9, including the additional step of deforming said first end of said first rebar by means of an electric impact hammer.

12. The method recited in claim 9, including the additional step of deforming said first end of said first rebar by means of a hydraulic jack.

13. A method for coupling a first rebar to a second rebar, said method comprising the steps of:

locating a first slidable screw threaded coupling member around a first end of said first rebar;

locating a second slidable screw threaded coupling member around a first end of said second rebar;

upsetting said first ends of said first and second rebars to form a relatively wide head on each of said first ends to block the removal of said first and second slidable screw threaded coupling members from said first ends; and sliding said first and second screw threaded coupling members towards one another along respective first ends of said first and second rebars and screwing said coupling members into mating engagement with a third screw threaded coupling member having first and second screw threaded ends, such that said relatively wide heads formed on each of said first ends of said first and second rebars are retained at the respective first and second screw threaded ends of said third screw threaded coupling member.

14. The method recited in claim 13, including the additional step of upsetting said first ends of said first and second rebars by first heating said first ends and then deforming said first ends.

15. The method recited in claim 13, including the additional steps of heating said first ends of said first and second rebars by means of a torch and deforming said first ends by means of an electric impact hammer.

16. The method recited in claim 13, including the additional steps of heating said first ends of said first and second rebars by means of a torch and deforming said first ends by means of a hydraulic jack.

17. The method recited in claim 13, wherein each of said first and second screw threaded coupling members is a hollow male coupling nut having a set of external screw threads, and said third screw threaded coupling member is a hollow female coupling cylinder having a set of internal screw threads at each of said first and second screw threaded ends thereof, said first and second screw threaded coupling members being connected to said third screw threaded coupling member such that said female coupling cylinder surrounds each of said first and second male coupling nuts with said set of internal screw threads at the first screw threaded end of said female coupling cylinder being mated to said set of external screw threads of said first male coupling nut and said set of internal screw threads at the second screw threaded end of said female coupling cylinder being mated to said set of external screw threads of said second male coupling nut.

18. The method recited in claim 17, including the additional step of forming an annular wall at the interior of said female coupling cylinder, said annular wall projecting radially inward from said female coupling cylinder between said relatively wide heads that are formed on said first ends of each of said first and second rebars and retained at the respective first and second screw threaded ends of said female coupling cylinder.

19. The method recited in claim 17, including the additional step of injecting grout into said female coupling cylinder between said relatively wide heads formed on said first ends of each of said first and second rebars that are retained at the respective first and second screw threaded ends of said female coupling cylinder so as to absorb compressire loads that are applied to said first and second rebars.

* * * * *